US005873477A

United States Patent [19]

Jago

[11] Patent Number: 5,873,477

[45] **Date of Patent: *Feb. 23, 1999**

[54] BOTTLE HAVING A BASE STRUCTURE ON WHICH IT CAN BE SPUN ABOUT ITS CENTRAL AXIS

[75] Inventor: Thomas Edwin Jago, London, United Kingdom

[73] Assignee: Chivas Brothers Limited, Paisley, Scotland

[ * ] Notice: This patent issued on a continued prosecution application filed under 37 CFR 1.53(d), and is subject to the twenty year patent term provisions of 35 U.S.C. 154(a)(2).

[21] Appl. No.: 571,441

[22] Filed: Dec. 13, 1995

[30] Foreign Application Priority Data

Dec. 19, 1994 [GB] United Kingdom ..... 9426057

[51] Int. Cl.[6] ..... B65D 1/02; B65D 23/00

[52] U.S. Cl. ..... 215/372; 215/373; 220/603; 273/147

[58] Field of Search ..... 215/12.1, 370, 215/371, 373, 372, DIG. 7, 377; 220/568, 628, 739, 603; 273/141, 147, 138

[56] References Cited

U.S. PATENT DOCUMENTS

| | | | |
|---|---|---|---|
| 1,416,347 | 5/1922 | Gregory . | |
| 2,013,615 | 9/1935 | Fontan | 220/568 |
| 2,036,407 | 4/1936 | Godfrey | 220/568 |
| 2,102,520 | 12/1937 | De Montmorency | 220/568 |
| 2,305,896 | 12/1942 | Pratt | 215/12.1 |
| 2,574,398 | 11/1951 | Krebeck | 273/141 R |
| 3,341,184 | 9/1967 | Merrill | 215/371 X |
| 3,717,274 | 2/1973 | Wingardh | 215/DIG. 7 X |
| 3,887,069 | 6/1975 | Diwo | 215/12.1 X |
| 4,892,206 | 1/1990 | Perrin | 215/12.1 |
| 5,141,136 | 8/1992 | Tignor | 215/373 X |
| 5,450,979 | 9/1995 | Servick et al. | 220/739 |

FOREIGN PATENT DOCUMENTS

| | | | |
|---|---|---|---|
| 851544 | 1/1940 | France | 215/40 |
| 1492942 | 8/1967 | France | 215/370 |
| 429903 | 2/1948 | Italy | 273/147 |
| 160656 | 3/1921 | United Kingdom | 220/628 |
| 306167 | 2/1929 | United Kingdom | 220/568 |
| 342 998 | 2/1931 | United Kingdom . | |
| 803600 | 10/1958 | United Kingdom | 273/147 |

*Primary Examiner*—Sue A. Weaver
*Attorney, Agent, or Firm*—Kane, Dalsimer, Sullivan, Kurucz, Levy Eisele and Richard, LLP

[57] ABSTRACT

A bottle 10 has a base portion 12 and a projection 22 on an underside of the base portion, the projection being disposed generally centrally on the base portion whereby the bottle can be spun on the projection about the bottle central axis 24.

22 Claims, 2 Drawing Sheets

BOTTLE HAVING A BASE STRUCTURE ON WHICH IT CAN BE SPUN ABOUT ITS CENTRAL AXIS

BACKGROUND OF THE INVENTION

The invention relates to a bottle and particularly, but not exclusively, to a bottle to be filled with a spirit such as whisky for sale to consumers.

SUMMARY OF THE INVENTION

The invention provides a bottle having a base portion and a projection on an underside of said base portion, the projection being disposed generally centrally of the base portion whereby the bottle can be spun on the projection about the bottle central axis.

Advantageously, the weight distribution of the bottle about said central axis is substantially uniform.

The projection may be a plastics insert.

The plastics insert may be partially received in said base portion.

The base portion may define a depression, said projection being disposed in said depression and partially projecting therefrom.

Preferably, the bottle has an elongate neck merging into a flared lower portion which merges with said base portion.

In one embodiment, a major diameter of said lower portion is approximately five times the diameter of said neck portion.

The bottle may further comprise indicating means whereby, in use, a rotational position of the bottle can be indicated.

The indicating means may comprise at least one projection disposed on the outer surface of said lower portion.

The invention also includes a bottle having a base portion and a projection on an underside of said base portion, the projection being disposed generally centrally of the base portion whereby the bottle can be spun on the projection about the bottle central axis, wherein said base portion defines a depression, said projection being disposed in said depression and partially projecting therefrom.

The invention also includes a bottle comprising:

an elongate neck, a lower portion and a base portion, said neck merging with said lower portion and said lower portion merging with said base portion;

a projection disposed on an underside of said base portion generally centrally of the base portion and in a depression defined by said base portion, said projection being arranged to project from said depression whereby the bottle can be spun on the projection about the bottle central axis; and indicating means whereby, in use, a rotational position of the bottle can be indicated.

BRIEF DESCRIPTION OF THE DRAWINGS

In order that the invention may be well understood, an embodiment thereof, which is given by way of example only, will now be described with reference to the accompanying drawings, in which.

A bottle 10 has a base portion 12 and an elongate neck 14 merging into a flared lower portion 16 which in turn merges with the base portion.

Figure 1:
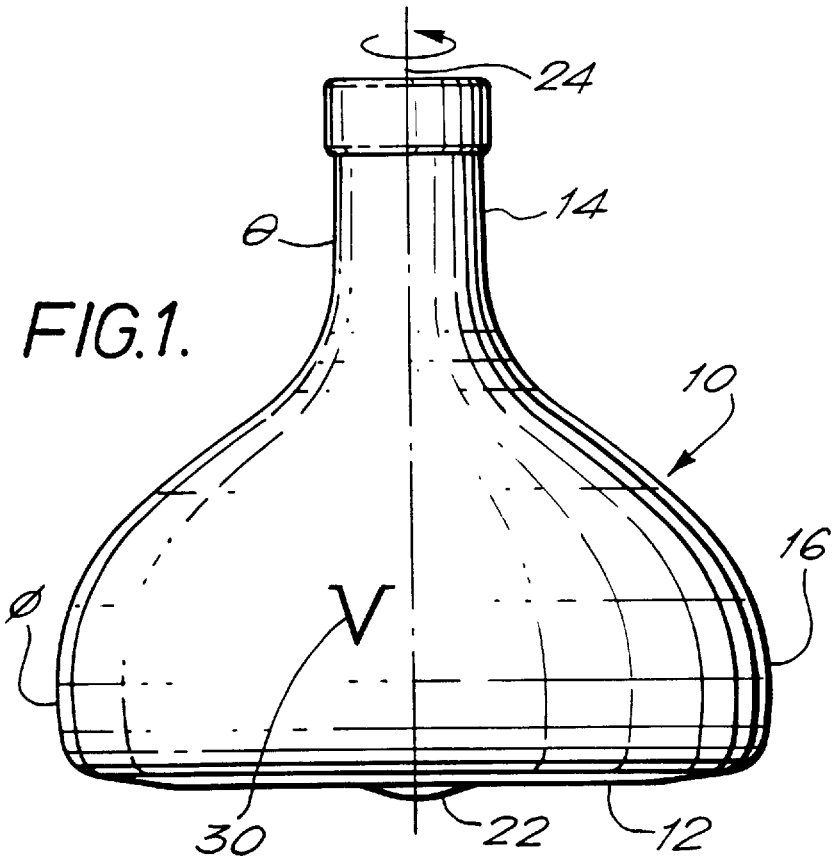
FIG. 1 is a side view of a bottle according to the invention.
Figure 2:
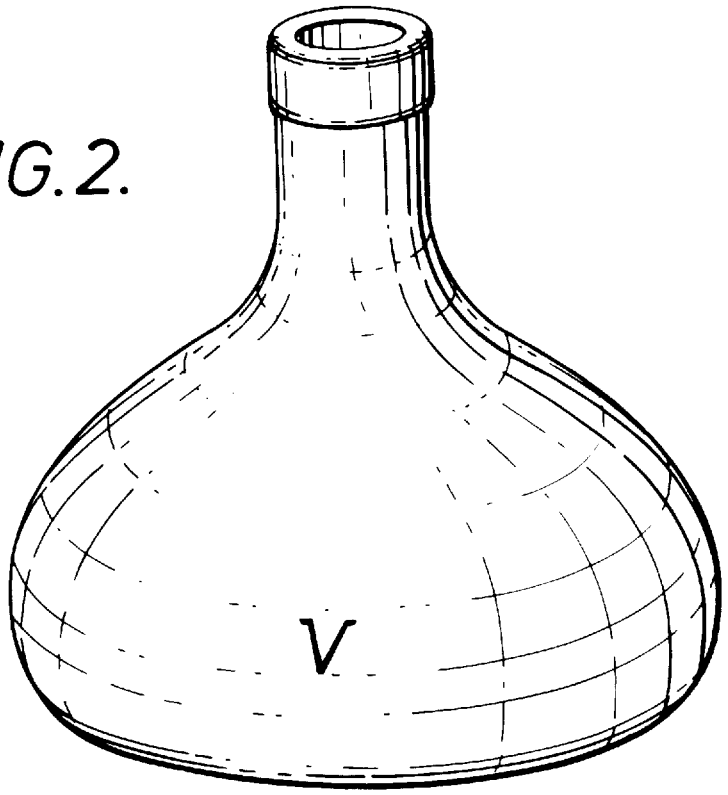
FIG. 2 is a perspective view from above of the bottle.
Figure 3:
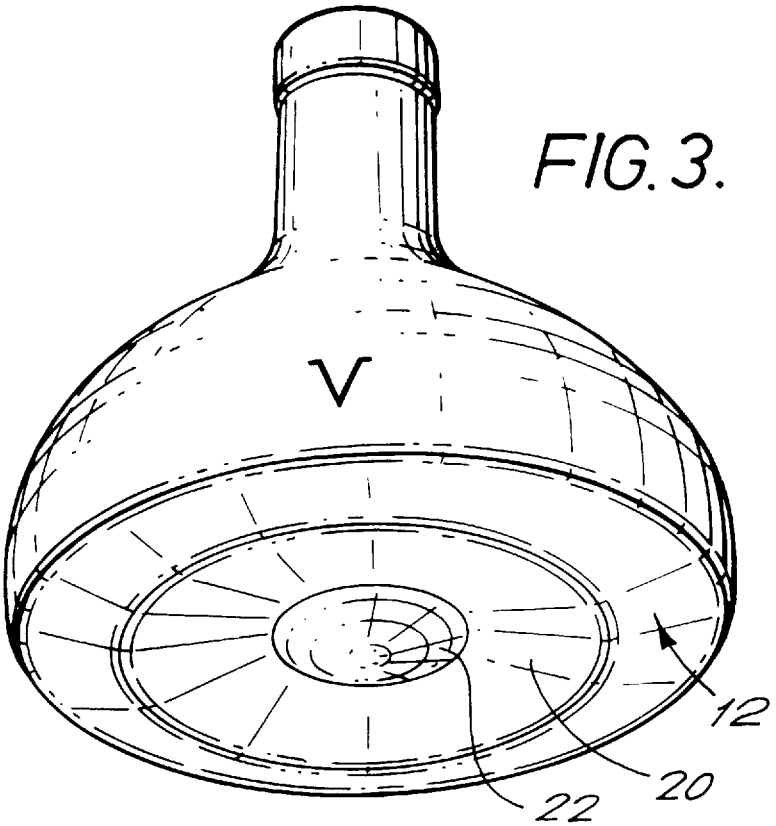
FIG. 3 is a perspective view from below of the bottle.
Figure 4:
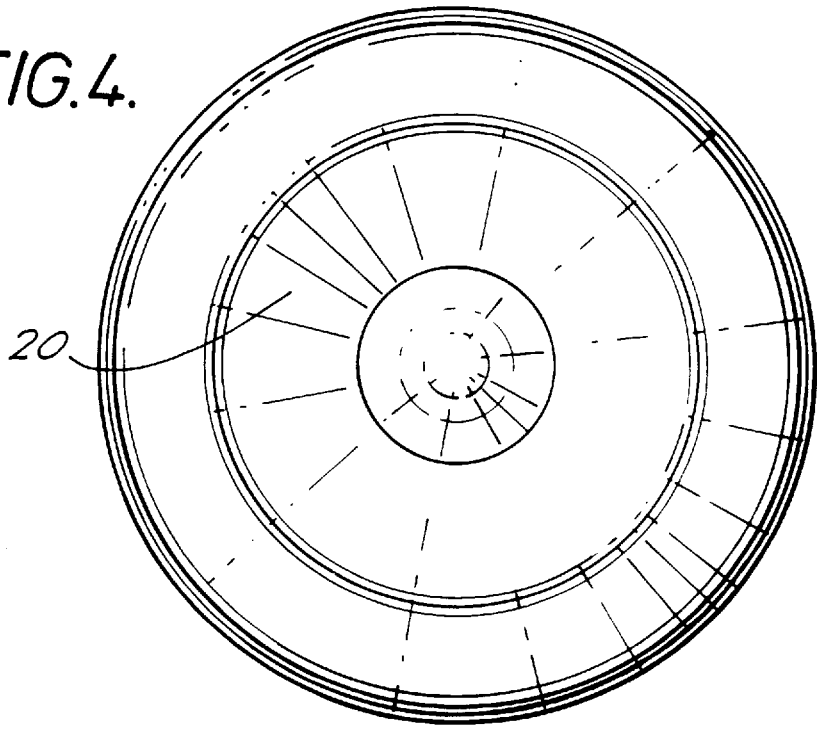
FIG. 4 is a plan of an underside of the base portion of the bottle.

The base portion 12 defines a depression, or hollow, 20 which is disposed generally centrally of the base portion. Also disposed generally centrally of the base portion is a generally conical projection 22 provided on an underside of the base portion which is disposed in the depression 20 and projects therefrom, as shown in FIG. 1.

The projection is arranged such that the bottle can be spun about its central axis 24 on the projection. In order that the bottle can be spun about its central axis without significant rocking, or oscillatory, movement about the axis 24, the bottle 10 is configured such that the weight distribution of the bottle about the central axis is substantially uniform.

It will be appreciated that in order to obtain good spin characteristics, the bottle is shaped to have its centre of gravity as close to the projection as possible and to effect this, the bottle is generally squat with the flared lower portion 16 being much wider than the neck 14. In the embodiment a major diameter $\phi$ of the lower portion is approximately five times the diameter $\theta$ of the neck. It will be noted that the bottle has a generally pear or bell-like shape and this has been found to provide good spin characteristics.

The projection 22 can be an integral part of the glass bottle 10 or may alternatively be a plastics insert fixed to or moulded into the base portion 12. It will be understood that a plastics insert can be more readily manufactured with close tolerances than an integral projection 22 so that improved spin stability can be achieved by use of a plastics insert. The plastics insert can readily be fixed to the base portion by providing a suitable depression therein into which the insert can be fitted.

In the embodiment, the projection is shown as being generally conical. It will be appreciated that other shapes may be used and that the projection may include a flat surface portion on which the bottle can stand when not being spun.

An indicating means in the form of a V-shaped projection 30 is disposed on the outer surface of the lower portion 16. The projection 30 allows the change in rotational position of the bottle after spinning to be gauged. It is envisaged that the bottle could be used for playing games at a party or the like with the bottle being spun and the direction in which the projection 30 is pointing after spinning providing a chance element in a game. For example, the spinning of the bottle could be used in a game where a person positioned substantially in line with the projection 30 after spinning is required to perform a particular action.

It will be understood that the indicating means can comprise more than one projection 30 and alternatively, a depression, or depressions, in the surface of the bottle could be used as an indicating means.

I claim:

1. A bottle comprising:

an elongate neck, a lower portion and a base portion, said neck merging with said lower portion and said lower portion merging with said base portion;

a projection disposed on an underside of said base portion generally centrally of the base portion in a depression defined by said base portion and being arranged to project from said depression; and indicating means whereby, in use, a rotational position of the bottle can be indicated, the arrangement being such that a central axis of said bottle extends through said projection, base portion, lower portion and neck and the bottle can be spun about said central axis on said projection such that an outcome of a game is indicated by a rotational position of the bottle indicated by said indicating means.

2. A bottle as claimed in claim 1, wherein the weight distribution of the bottle about said central axis is substantially uniform.

3. A bottle as claimed in claim 1, wherein said projection comprises a plastics insert.

4. A bottle as claimed in claim 3, wherein said plastics insert is partially received in said base portion.

5. A bottle as claimed in claim 1, wherein a major diameter of said lower portion is approximately five times the diameter of said neck.

6. A bottle having a neck, a base portion, a lower portion extending between said neck and said base portion, a projection disposed generally centrally on an underside of said base portion and projecting therefrom and a central axis extending through said projection, base portion, lower portion and neck, the neck, base portion and lower portion being configured and arranged such that said bottle is generally bell-shaped and can be spun on the projection about the bottle central axis.

7. A bottle as claimed in claim 6, wherein the weight distribution of the bottle about said central axis is substantially uniform.

8. A bottle as claimed in claim 6, wherein said projection comprises a plastics insert.

9. A bottle as claimed in claim 8, wherein said plastics insert is partially received in said base portion.

10. A bottle as claimed in claim 6, wherein a major diameter of said lower portion is approximately five time the diameter of said neck.

11. A bottle as claimed in claim 6, further comprising indicating means whereby, in use, a rotational position of the bottle can be indicated.

12. A bottle as claimed in claim 11, wherein said indicating means comprises a projection disposed on an outer surface of said lower portion.

13. A bottle as claimed in claim 6, containing a beverage consisting of a spirit.

14. A bottle having a neck having a diameter, a base portion, a lower portion extending between said neck and said base portion, a projection on an underside of said base portion and a central axis extending through said projection, base portion, lower portion and neck, wherein said base portion defines a depression and said projection is disposed in said depression and partially projects therefrom such that said bottle can be spun on said projection about said central axis and wherein a major diameter of said lower portion is approximately five times said diameter of said neck.

15. A bottle as claimed in claim 14, wherein said neck, base portion and lower portion are configured such that said bottle is generally bell-shaped.

16. A bottle as claimed in claim 14, wherein the weight distribution of the bottle about said central axis is substantially uniform.

17. A bottle as claimed in claim 14, wherein said projection comprises a plastics insert.

18. A bottle as claimed in claim 17, wherein said plastics insert is partially received in said base portion.

19. A bottle as claimed in claim 14, further comprising indicating means whereby, in use, a rotational position of the bottle can be indicated.

20. A bottle as claimed in claim 19, wherein said indicating means comprises a projection disposed on an outer surface of said lower portion.

21. A bottle as claimed in claims 14, containing a beverage consisting of a spirit.

22. A bottle having a neck, a base portion, a lower portion extending between said neck and said base portion, a projection disposed generally centrally on an underside of said base portion and projecting therefrom and a central axis extending through said projection, base portion, lower portion and neck, the neck, base portion and lower portion being configured and arranged such that said bottle is generally bell-shaped and can be spun on the projection about the bottle central axis and wherein said bottle is provided with indicating means whereby, in use, a rotational position of the bottle can be indicated such that an outcome of a game indicated by a rotational position of the bottle indicated by said indicating means.

* * * * *